United States Patent [19]

Vinnikov

[11] Patent Number: 4,943,300

[45] Date of Patent: Jul. 24, 1990

[54] PROCESS FOR CONDITIONING COTTON

[76] Inventor: Lev Vinnikov, 2/8 Oswaldo Arenia, Beer-Sheva, Israel

[21] Appl. No.: 225,242

[22] Filed: Jul. 28, 1988

[30] Foreign Application Priority Data

Aug. 18, 1987 [IL] Israel ..... 83583

[51] Int. Cl.[5] ..... D01B 3/04

[52] U.S. Cl. ..... 19/66 R; 19/66 CC

[58] Field of Search ..... 19/66 R, 66 CC

[56] References Cited

U.S. PATENT DOCUMENTS 2,747,234 5/1956 Speakes et al. ..... 19/66 CC
2,815,536 12/1957 Bryant ..... 19/66 CC
2,834,058 5/1958 Bryant ..... 19/66 CC
2,867,851 1/1959 Mitchell et al. ..... 19/66 CC
3,005,238 10/1961 Manning ..... 19/66 R
3,247,552 4/1966 Bryant et al. ..... 19/66 CC

*Primary Examiner*—Werner H. Schroeder
*Assistant Examiner*—D. Price
*Attorney, Agent, or Firm*—Lerner, David, Littenberg, Krumholz & Mentlik

[57] ABSTRACT

A process for conditioning cotton is described, in which cotton is brought to a moisture content of about 8–9%, by contacting it with humid air which possesses a residual relative humidity, after contact, of about 65% to 80%, and a temperature comprised between about 35° C. and 95° C.

6 Claims, 2 Drawing Sheets

PROCESS FOR CONDITIONING COTTON

FIELD OF THE INVENTION

The present invention relates to a process for conditioning cotton, especially cotton fibers.

BACKGROUND OF THE INVENTION

Cotton fibers are produced from raw cotton at ginning plants, by the removal of dirt and impurities found therein, and the ginning process—separation of fibers from seeds. In order effectively to remove dirt, the moisture content must be reduced first by drying the raw cotton from the normally found 9–17% of moisture, to about 3–5%. However, while this relatively low humidity of the cotton is required for cleaning purposes, it is undesirable for industrial processing of cotton fibers because the physical properties of the fiber are dependent from its moisture content. A too dry fiber lacks elasticity and becomes difficult to weave. The normally required moisture of cotton fibers for the textile industry is about 8–9%.

Throughout this specification by conditioning is meant the restoration of water to cotton, in a controlled manner, to reach a predetermined desired moisture range. Throughout this specification, percentages are given as weight percent, and water contents are given as weight percent on a dry basis, that is, percent water for unit weight of dry fiber.

In addition to the quality of the fiber, conditioning of cotton presents other industrial advantages, such as an easier pressing of fibers for baling purposes.

THE PRIOR ART

The art currently employs processes and apparatuses for conditioning cotton, which however suffer different serious drawbacks. In one such process atomized water is caused to penetrate the cotton, which causes overwetting of the cotton resulting in the formation of yellow spots on the fibers during bale storage, and may lead to the growth of undesirable microorganisms. Furthermore, it is practically impossible to reach the desired 8–9% moisture, and only 6–7% can be obtained without overwetting the product.

Another process is based on the adsorption of water vapor from humid air, thus eliminating the dangerous direct contact with water. However, this process has the severe drawback of being extremely difficult to control, because by its nature it is very much dependent on the ambient temperature and humidity and on the input moisture of the fiber. In addition, the resulting moisture distribution in the fiber is non-homogeneous, the process is unstable because it depends on uncontrollable parameters, and practically only a 6–7% moisture can be achieved, without overwetting the product. This derives from the fact that the above process does not allow for an efficient control. Therefore, since practical cotton moisture variations, due to the dependence on uncontrollable parameters, is more than 2%, it is dangerous to keep the target moisture on levels higher than 7%.

It is therefore apparent that there is a long felt want of a process and apparatus for carrying it out, which will provide a correct and controllable conditioning of cotton, to give the desired about 8–9% moisture of the clean fiber.

SUMMARY OF THE INVENTION

It is an object of the present invention to provide such a process which permits to reach the desired moisture, to provide a homogeneously moisturized product, while eliminating the influence of ambient conditions and the resulting instability of the process.

It has now been surprisingly found, and this is an object of the invention, that there is a critical minimal value for the relative humidity of air, which is employed as the conditioning medium, namely 65% relative humidity (RH), below which the desired mositure range of 8–9% cannot be obtained when operating at temperatures above 30° C.

It has further been surprisingly found and this is still another object of the invention, that a maximal RH value for the process of the invention also exists, namely 80%, above which the desired moisture range is exceeded and a runaway process may take place.

It has further been most surprisingly found, and this is still another object of the invention, that when working in the RH range 65–80%, not only the desired fiber moisture range of 8–9% can be reached, but also the process is very weakly dependent on the temperature of the humid air, and for practical purposes this parameter needs not be strictly controlled.

The process for conditioning cotton fibers to a moisture content in the range of about 8% to about 9%, according to the invention, in which humid air is brought into contact with the cotton fibers, is characterized in that the relative humidity of air leaving the cotton fibers after conditioning is in the range of about 65% to about 80%, and the temperature of air is comprised between about 35° C. to about 95° C. Preferably, the temperature of the air is equal to or less than 60° C.

According to a preferred embodiment of the invention the relative velocity between the conditioning air and the cotton fibers is at least 1.5 m/sec, throughout the conditioning effective volume of the conditioning apparatus.

The conditioning apparatus may be of any appropriate type known in the art, such as of the moving shell, pneumotransport, fluidized bed type or the like.

It should be understood that in this specification, whenever reference is made to a permissible or desired RH, it is meant the relative humidity found at the end of the conditioning process, viz., at the outlet of the moisturizing apparatus. At limiting conditions, the conditioning process does not necessarily begin with the above-defined maximal permissible RH. On the contrary, the process may begin, for instance, with a 90% RH and, given the correct residence-time and temperature, equilibrium conditions will be attained at 80% RH, without exceeding the desired moisture content of the cotton.

BRIEF DESCRIPTION OF THE DRAWINGS

FIG. 2(*b*) shows a plot of residence time v. relative humidity for cotton fibers moisturized from 4% to 8% moisture at 40° C.

DETAILED DESCRIPTION OF PREFERRED EMBODIMENTS

Figure 1:
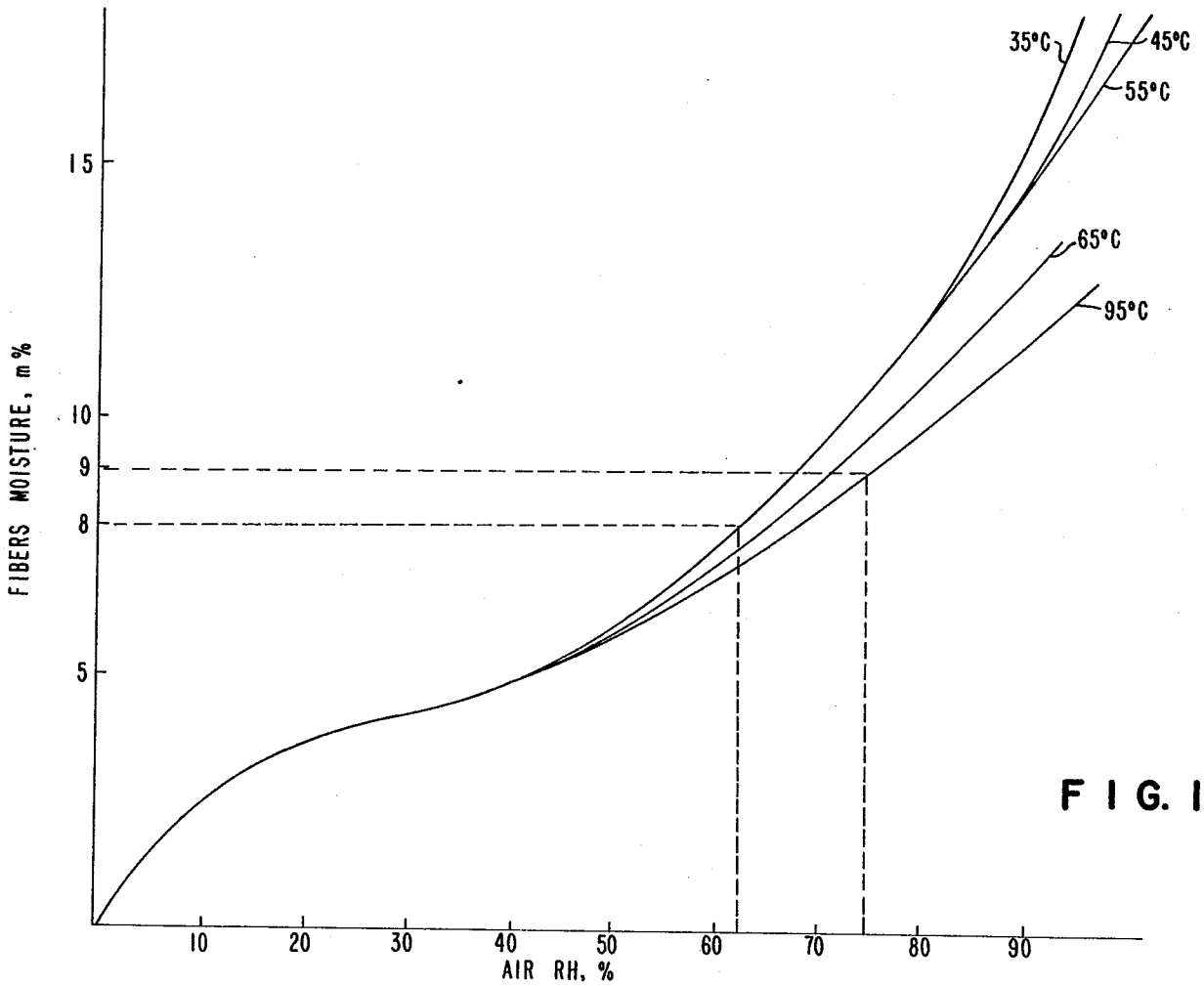
FIG. 1 shows a plot of moisture equilibrium conditions for cotton fibers at air temperatures between 35° C. and 95° C.

The above situation is schematically shown in FIG. 1, which corresponds to the equilibrium conditions of cotton fibers at different air temperatures. As it can be seen, the desired 8–9% fiber moisture range corresponds to about 65–80% air RH, for the air temperature range of 35° C. to 95° C. In looking at this figure it should be understood that it is meant to indicate a general feature of the conditioning process, but it is not meant to provide a universally true and exact set of data. Providing general curves is not possible because cotton is a raw material having varying characteristics. Cotton may be different because it is grown in different zones and is brought to the plant from the field at different times, so that differences will exist between different batches of cotton, even if grown in the same field. The person skilled in the art, however, will easily overcome any problem deriving from fluctuations in cotton quality by testing a batch to obtain basic data thereon, as known to the skilled person and as hereinafter described.

However, it has been discovered that in order to obtain smooth kinetic curves of cotton moisturizing the temperature of humid air should not exceed 60° C. Higher temperatures result in inconstant and unstable process conditions. Another factor which has not been taken into account in the art of cotton conditioning is the relative velocity (V) between the moisturizing air and cotton fibers. In known processes, such as the Samuel Jackson process (ordinarily carried out in the HU 60-1066 Gas-Fired Humidaire Unit, manufactured by Samuel Jackson Manufacturing Corp., U.S.A.) such relative velocity is of the order of magnitude of 0.5 m/sec. The art has not recognized the importance of this parameter to the conditioning process. However, in order to obtain optimal results, the velocity of air relative to the cotton fibers should be at least 1.5 m/sec, for the active conditioning volume of the conditioning apparatus.

Figure 2A:
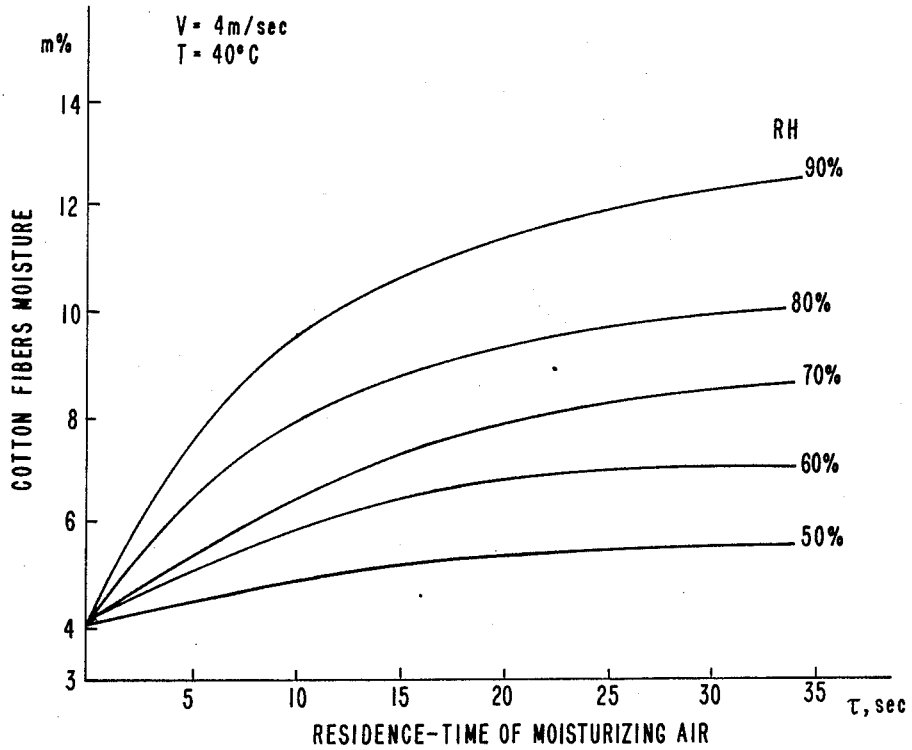
FIG. 2(*a*) shows a plot of fiber moisture v. residence time for cotton fibers moisturized with air having a relative humidity between 50% and 90%.
Figure 2B:
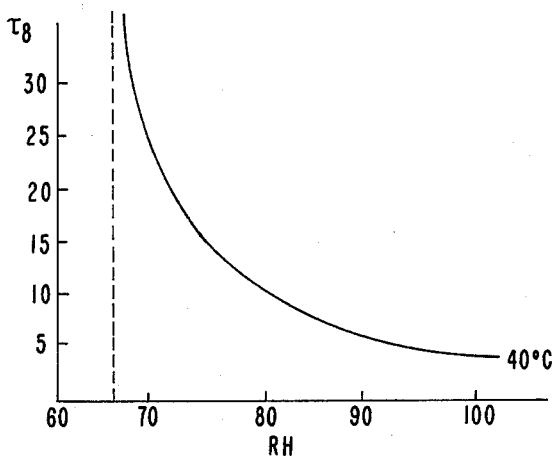
Figure 3:
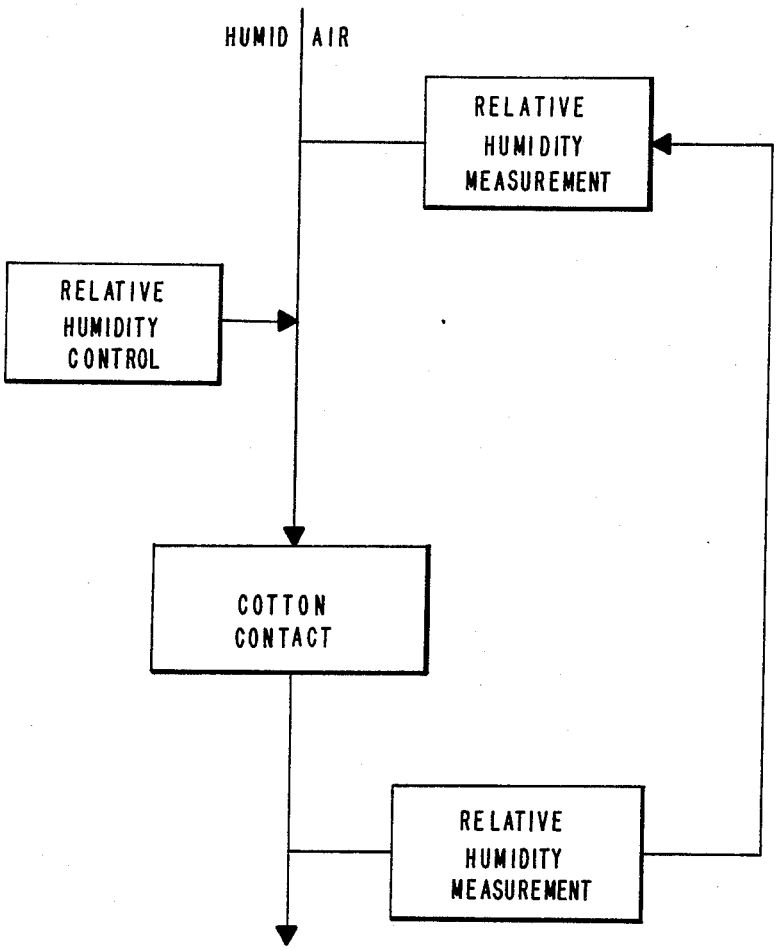
FIG. 3 is a flow chart showing the method steps of the present invention.

In addition, the residence-time of cotton fibers within the moisturising volume is an important industrial factor. FIG. 2(*a*) shows kinetic data for the moisturizing process at 40° C. and V=4 m/sec. From the data in the figure it can be seen that the maximal residence time needed in order to condition a 4% moisture fiber to 8% moisture is about 30 sec. FIG. 2(*b*) shows the dependence of the mean residence-time, $_8$, on the RH, which is built from the data of FIG. 2(*a*), and shows that it can be decreased to about 5 sec with a RH of 90%. Similar curves can be provided for each temperature and relative velocity, as will be apparent to a person skilled in the art, from which the relevant process parameters can be selected.

According to a preferred embodiment of the invention the humidifying air is recirculated in large volumes in the conditioning apparatus, and its RH and temperature are adjusted when recirculating it to the desired values. This recirculation achieves some industrially important goals, such as the easy control of air parameters, as opposed to what takes place in open humidifying apparatus, and the neutralization of exothermal effects due to water adsorption by cotton, which can cause a desorption thereof into air and an instability of the process.

The following examples illustrate the conditioning of cotton.

EXAMPLE 1

A sample of appoximately 20 gr was equilibrated to about 4% moisture by keeping it for 24 hours in a desiccator, in contact with air having a 27% RH at 30° C. This sample was weighed in a closed Petri dish, with an accuracy of 0.01 gr, and placed for 23 seconds in a moisturizing air stream with a 70% RH, a temperature of 40° C. and a velocity (V) of 4 m/sec.

The sample taken out of the air stream was weighed and then oven dried at 105° C. to constant weight (about 45 minutes), after which period the sample was weighted again. Control samples were also dired and weighed, to determine the exact moisture content of the sample before conditioning. The sample contained 4.1% moisture before conditioning, and 8.3% after the 23 second period.

The sample holder consisted of a closed basket with netted walls, thorugh which air can flow.

EXAMPLE 2

Operating as in Example 1, a 25 g sample was moisturized with air at 40° C., RH=85% (initial value) and V=4 m/sec. After 8 seconds the moisture content of the sample raised from the original 3.9% to the final value of 7.8%.

EXAMPLE 3

Operating as in Example 1, a 18 g sample was moisturized with air at 50° C., RH=70% (initial value) and V=4 m/sec. After 20 seconds the moisture content of the sample raised from the original 4% to the final value of 8.2%.

EXAMPLE 4

Operating as in Example 1, a 27 g sample was moisturized with air at 40° C., RH=85% (initial value) and V=2 m/sec. After 12 seconds the moisture content of the sample raised from the original 4.2% to the final value of 8.3%.

The above description and examples have been given for the purpose of illustration and are not intended to be limitative. Many modifications of the process of the invention are possible. Different sets of parameters such as RH, temperature and velocity can be selected, or different types of cotton having different initial parameters can be employed, without exceeding the scope of the invention.

What I claim is:

1. A process for moisturizing cleaned cotton to a moisture content between about 8 and about 9% comprising:

providing a stream of humid air having a predetermined relative humidity and a temperature between about 35 and about 95° C.;

contacting said cotton with said stream of humid air so that said cotton adsorbs water vapor from said humid air so as to provide a stream of reduced humidity air, determining the relative humidity of said stream of reduced humidity air; and controlling said predetermined relative humidity so that said stream of reduced humidity air has a relative humidity between about 65 and about 80%.

2. The process of claim 1, wherein said temperature of said stream of humid air is less than about 60° C.

3. The process of claim 1, wherein said contacting of said cotton with said stream of humid air is carried out at a velocity relative to said cotton of at least 1.5 m/sec.

4. The process of claim 1, further comprising the step of recycling said stream of reduced humidity air after said contacting step.

5. The process of claim 4, further comprising the step of restoring the humidity of said stream of reduced humidity air to said predetermined relative humidity and to said temperature of between about 35 and about 95° C.

6. The process of claim 1, wherein said contacting step is performed for a duration of between about 5 and about 30 seconds.

* * * * *